United States Patent [19]

Nixon

[11] 4,079,934

[45] Mar. 21, 1978

[54] TETHERED BALL TENNIS PRACTICE DEVICE

[76] Inventor: Alan C. Nixon, 2727 Marin Ave., Berkeley, Calif. 94708

[21] Appl. No.: 703,434

[22] Filed: Jul. 8, 1976

[51] Int. Cl.[2] ..... A63B 69/38

[52] U.S. Cl. ..... 273/29 A; 273/26 E; 273/58 C

[58] Field of Search ..... 273/29 A, 26 A, 26 E, 273/58 C, 95 A, 184 B, 185 C, 30; 43/21.2

[56] References Cited

U.S. PATENT DOCUMENTS

| | | | |
|---|---|---|---|
| 2,784,512 | 3/1957 | Goodwin | 273/58 C |
| 2,848,236 | 8/1958 | Gibson | 273/58 C |
| 3,166,316 | 1/1965 | O'Leary | 273/26 E |
| 3,477,717 | 11/1969 | Clark | 273/30 |
| 3,829,093 | 8/1974 | Abrams | 273/58 C |

OTHER PUBLICATIONS

The Sunday Star, Washington, D. C., Apr. 10, 1949.

*Primary Examiner*—Richard C. Pinkham
*Assistant Examiner*—T. Brown

[57] ABSTRACT

A device is provided for practice hitting a tennis ball, the device comprising a flexible pole adapted to be held in one hand, or fixedly secured in a suitable support, the pole mounting a retrievable line to the free end of which a tennis ball is attached. The ball is provided with a swivel element placed in the interior thereof. One end of the swivel element is attached to the wall of the tennis ball and the other end of the swivel element is attached to the retrievable line which extends through the wall of the ball at a point diametrically opposed to the point at which the other end of the swivel element is attached.

3 Claims, 4 Drawing Figures

TETHERED BALL TENNIS PRACTICE DEVICE

BACKGROUND OF INVENTION

Recreation devices of the tethered ball type are well known and widely used by those who wish to improve their skill at tennis, baseball, golf and the like. Typical of such devices are those wherein a ball is attached to the end of a cord the opposite end of which is attached to a pole, and the player's strength and agility are measured by striking the ball in a manner to wind the cord around the pole. Among the many U.S. patents covering devices of this type is U.S. Pat. No. 3,107,094 Kjoury Oct. 15, 1963 which discloses apparatus for playing a ball game wherein a pole is mounted vertically in the ground and a wire helix is attached to the top of the pole, the ball being fastened to a cord the opposite end of which is secured in a ring mounted on the wire helix. The object of the game is to strike the ball in a manner to cause the ring to reach the end of the helix. Another device for simulating baseball practice is disclosed in U.S. Pat. No. 3,216,723 Galezniak Nov. 9, 1965. This device comprises a pole adapted to be supported vertically in the ground with a rotary cable support means clamped to the top of the pole the ball being attached to a cord the opposite end of which is fastened to the rotary cable support. Still other tethered ball devices are illustrated by U.S. Pat. No. 3,408,070 Gonzales et al Oct. 29, 1968; U.S. Pat. No. 3,764,140 Lofty Oct. 9, 1973 and U.S. Pat. No. 3,790,171 Anderson Feb. 5, 1974.

In all of these devices however the flight of the ball is restricted to substantially circular movement of relatively short radius about the pole, and as a consequence lacks the free flight pattern of a tennis or baseball being returned by a competative player.

SUMMARY OF INVENTION

The intant invention relates, in general, to an improved device for practicing tennis strokes and in particular a device that will permit the ball to be driven at relatively great distances in substantially straight flight from a solo player; and then speedily returned to the player in any one of a large variety of flight patterns for taxing the player's skill. Further the relatively free flight of the ball enables the player to practice various kinds of strokes such as an overhand drive, a chop, a lob and the like.

In brief the device of this invention comprises a flexible rod one end of which may be held in the player's hand; or alternatively set into the ground or other fixed supporting means. Attached to this end of the pole is line-supply-and-retrieving means, as for example a reel, from which a line extends to the opposite or top end of the pole, suitable guide means being provided at the top and at points spaced along the length of the pole for guiding the line. The free end of the line extends through the top guide means and is attached to a ball. When used to simulate a tennis game the ball is a depressurized rubber ball and the free end of the line is attached to the ball by swivel joint means.

PREFERRED EMBODIMENT OF INVENTION

Figure 1:
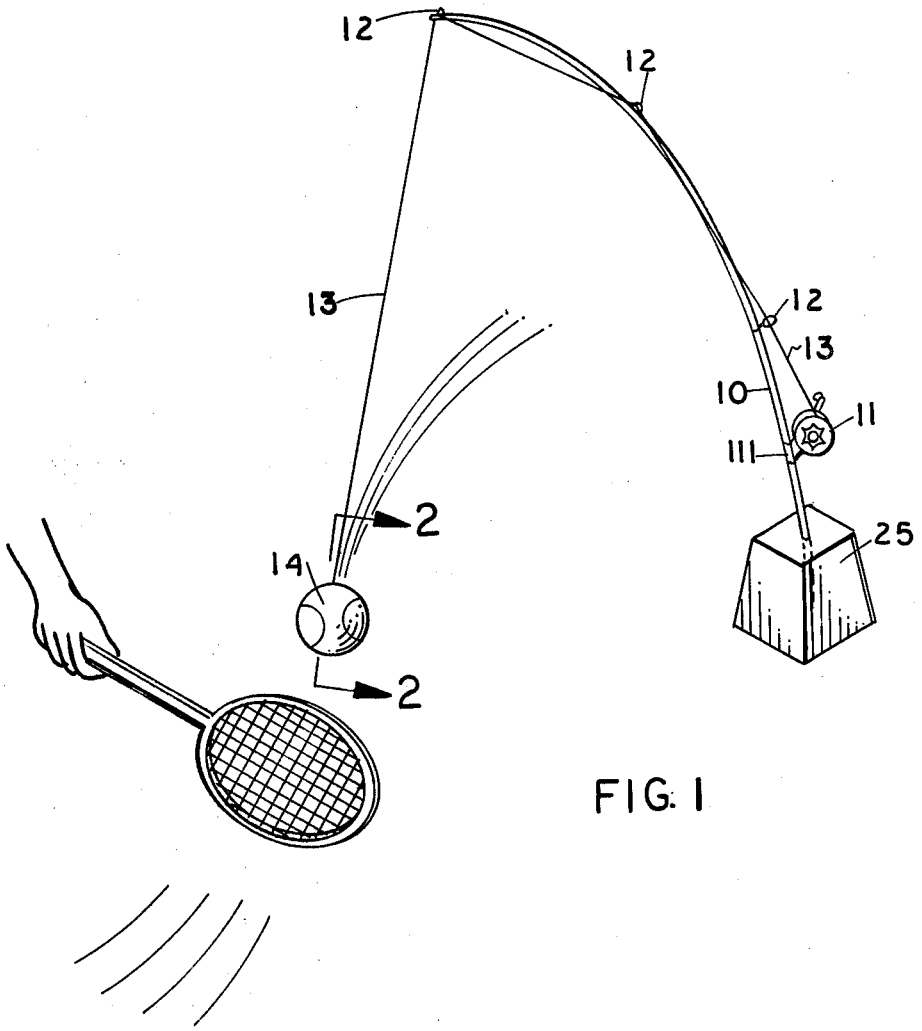
FIG. 1 is an overall view of the ball practicing device of this invention showing the device in use.

Referring to the drawings, the playing device of this invention is shown as comprising a flexible rod 10, which may be a fishing rod, provided adjacent its lower end with line-supply-and-retrieving means 11 secured to the pole with suitable fastening means 111. The line supply and retrieving means may be a standard reel as used on fish poles and preferably a reel of the type equiped with line drag means, typical of which is the so-called Star-Drag. Spaced along the length of the pole are line guide means or eyelets 12 through which the line 13 is threaded. Similar line guide means is provided at the upper end of the pole through which the free end of the line passes.

Figure 2:
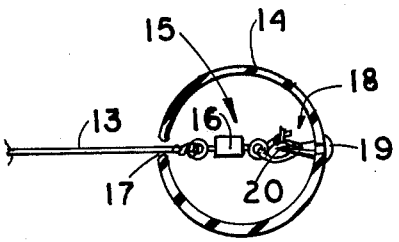
FIG. 2 is a section of the ball showing details of the swivel means for connecting the free end of the line to the ball.

The free end of the line is secured to a hollow ball 14 by swivel joint means indicated generally at 15 in FIG. 2. This comprises a standard swivel joiner 16 of the type sometimes used for connecting a fish lure to a fish line; and is adapted to be inserted inside the ball through a suitable aperture in its wall such as indicated at 17. The latter is provided with a snap-in metal or plastic collar 171 and as shown, the free end of the line passes through the collar 171 of the aperture 17 and is connected to one end of the swivel joiner 16. The opposite end of the swivel joiner 16 is adapted to be connected to the adjacent wall of the ball by suitable fastening means indicated generally at 18. As shown in FIG. 2 the fastening means 18 comprises a tapered pin 19 and more particularly a snap-in metal pin the tapered end of which is adapted to be pushed through an aperture in the wall of the ball. An aperture is provided in the tapered end of the pin and a ring 20 is engaged in this aperture, the ring 20 being engaged also in an eye in the adjacent end of the swivel joiner 16. The ball fastening means is thus substantially completely enclosed within the ball and permits exceptionally free movement of the ball relative to the line and pole.

Figure 4:
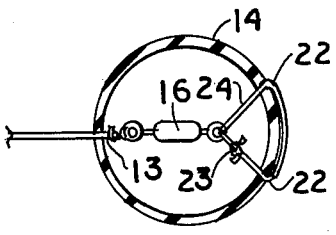
FIG. 4 is a section of a ball having alternative means for fastening the ball to the line.

Alternative fastening means for the ball and line is shown in FIG. 4. In this embodiment the swivel joiner 16 is adapted to be connected to the adjacent wall of the ball by a strong cord 21 which is strung through two relatively widely spaced apertures 22—22 in the wall of the ball. One end of the cord is then passed through the ring in the corresponding end of the swivel joiner 16 and the free ends of the cord are then tied together as indicated at 23 to form a closed loop 24 within the ball the ring of the swivel joiner 16 riding on the loop 24.

In use the rod is held normally in the left hand and the ball flicked out to the end of the line, which may be from 15 to 30 feet; and then jerked back towards the player who hits the ball with a tennis racket held in his right hand. The ball immediately flies away from the player and as it reaches the end of its flight is "played" by the player by letting the rod drift with the ball and then smoothly returning it to be struck again. Alternatively the pole may be fixedly supported in a substantially vertical playing position by a heavy block 25 as for example a block of concrete in which the lower end of the pole is secured. Although less skill is required with this arrangement nevertheless the flight of the ball, when struck, will still be relatively straight-away from the player due to the unreeling of the line thus simulating the true flight of the ball in a conventional tennis game.

Figure 3:
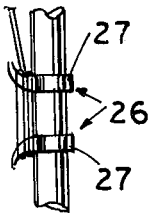
FIG. 3 is a fragmentary view of the pole provided with line take-up means.

The invention also contemplates means for storing the line when the device is not in use. As shown in FIG. 3 the storage means is indicated generally at 26 and may comprise a pair of clips 27-27 afixed to the rod in longitudinally spaced relationship therealong.

Although the ball used to illustrate the invention is a hollow rubber ball, i.e. tennis ball, it will be understood that other types of balls may be used as for example a solid rubber ball or a substantially rigid hollow plastic ball, suitable alterations being made in the fastening means by which the ball is attached to the line.

The invention may be carried out in other specific ways than those herein set forth without departing from the spirit and essential characteristics of the invention and the present embodiment is therefore to be considered in all respects as illustrative and not restrictive, and all changes coming within the meaning and equivalency range of the appended claims are intended to be embraced therein.

I claim:

1. A ball practice device comprising a flexible pole, line-supply and retrieving means, means attaching said line-supply and retrieving means to the first end of said pole, line guide means arranged at the second opposite end of said pole, at least one additional line guide means intermediate said first and second ends of said pole, a line extending from said line-supply and retriving means through all said line guide means, said line having a free end beyond said line guide means at said second end of said pole, a depressurized hollow rubber ball, swivel joint fastening means securing said ball to said free end of said line including a pin penetrating the wall of said hollow ball the portion of said pin said ball having an aperture therein, said swivel joint being connected at one end to the apertured end of said pin and the opposite end of said swivel joint being connected to the free end of said line.

2. Ball practice device according to claim 1 wherein said flexible pole is a fishpole and said line-supply-and-retrieving means comprises a reel having a line drag.

3. Ball practice device according to claim 2 wherein said pole is provided with line storage means for storing the line when not in use.

* * * * *